US006926394B2

(12) United States Patent
Bowling

(10) Patent No.: US 6,926,394 B2
(45) Date of Patent: Aug. 9, 2005

(54) ELASTOMERIC POLYMER CATCHER FOR CONTINUOUS INK JET PRINTERS

(75) Inventor: Bruce A. Bowling, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/387,968

(22) Filed: Mar. 13, 2003

(65) Prior Publication Data

US 2004/0179059 A1 Sep. 16, 2004

(51) Int. Cl.[7] ..... B41J 2/02
(52) U.S. Cl. ..... 347/73
(58) Field of Search ..... 347/90, 73–82; 216/27; 516/98

(56) References Cited

U.S. PATENT DOCUMENTS

| | | | | |
|---|---|---|---|---|
| 3,836,914 A | | 9/1974 | Duffield | |
| 4,024,548 A | | 5/1977 | Cialone | |
| 4,442,440 A | | 4/1984 | Elchinger | |
| 4,631,550 A | * | 12/1986 | Piatt et al. | 347/80 |
| 4,857,940 A | * | 8/1989 | Rueping | 347/90 |
| 5,475,411 A | * | 12/1995 | Strain et al. | 347/90 |
| 6,187,212 B1 | * | 2/2001 | Simon et al. | 216/27 |
| 6,648,461 B2 | * | 11/2003 | Long | 347/90 |
| 2002/0086908 A1 | * | 7/2002 | Chou et al. | 516/98 |

FOREIGN PATENT DOCUMENTS

| | | |
|---|---|---|
| EP | 0 8-5 039 | 5/1997 |
| EP | 1 186 424 | 3/2002 |
| WO | WO 03/018325 | 3/2003 |

* cited by examiner

*Primary Examiner*—K. Feggins
(74) *Attorney, Agent, or Firm*—Barbara Joan Haushalter

(57) ABSTRACT

A catcher device is provided for a continuous ink jet printer of the kind for generating a row of parallel selectively charged drop streams catches charged ink drops. The catcher device combines the attributes of two different materials, specifically a polymer and a metal, and two different processes, to eliminate high cost, material limitations, and geometry constraints associated with prior art catcher constructions.

18 Claims, 1 Drawing Sheet

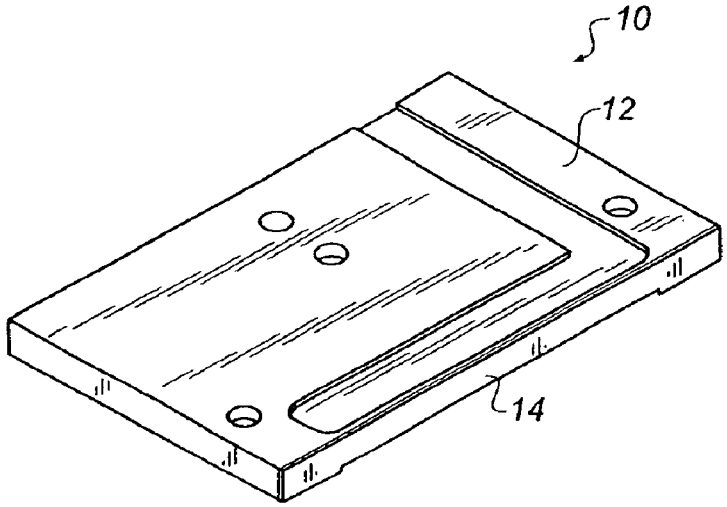
FIG. 1
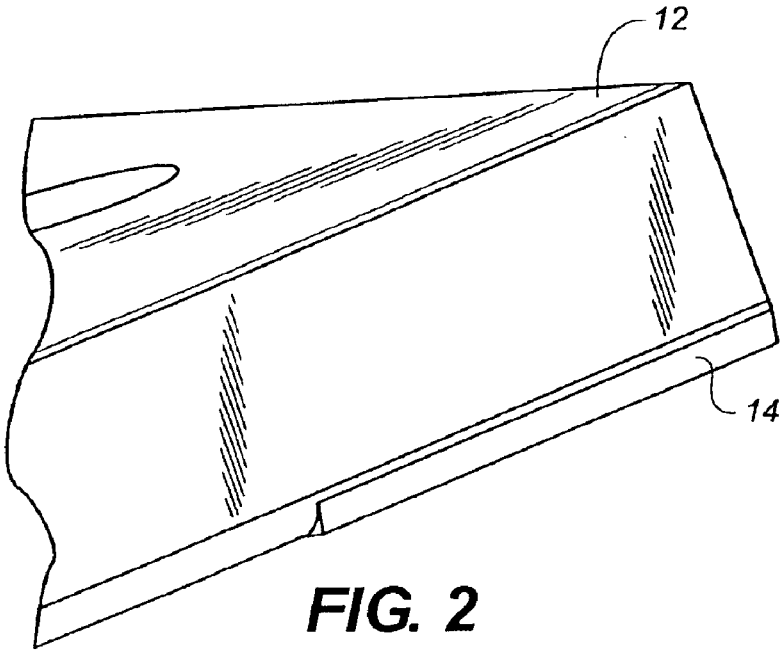
FIG. 2
| MATERIAL | SHRINKAGE RATE ΔL/L |
|---|---|
| POLYPHENYL SULFONE | 0.65% |
| EPDM ELASTOMER | 1.75% |
FIG. 3

ELASTOMERIC POLYMER CATCHER FOR CONTINUOUS INK JET PRINTERS

TECHNICAL FIELD

The present invention relates to continuous ink jet printers and, more particularly, to an improved catcher construction for producing complex and precision ink jet catcher geometries.

BACKGROUND ART

In general, continuous ink jet printing apparatus have a printhead manifold to which ink is supplied under pressure so as to issue in streams from a printhead orifice plate that is in liquid communication with the cavity. Periodic perturbations are imposed on the liquid streams, such as vibrations by an electromechanical transducer, to cause the streams to break-up into uniformly sized and shaped droplets.

A charge plate, comprising an array of addressable electrodes, is located proximate the streams break-off points to induce an electrical charge, selectively, on adjacent droplets, in accord with print information signals. Charged droplets are deflected from their nominal trajectory. For example, in a common, binary, printing mode, charged or non-print droplets are deflected into a catcher device and non-charged droplets proceed to the print medium.

A variety of catcher devices have been developed as constructions to intercept and recirculate the non-print droplets from such printheads. The catcher devices must take several potential problems into account. First, the catcher device must intercept the non-print ink droplets in a way that avoids splattering them onto the print medium, or scattering into an ink mist, which can also cause defects on the print media. Second, the catcher devices must effectively remove the caught ink away from the droplet interception zone so that a build-up of ink on the catching surface does not block the flight path of printing drops.

Planar charging continuous ink jet printers require a catcher to gather deflected drops of ink and assist their return back into the system. Drops that are not caught form printed images. Current art requires a precision metal catcher to achieve the functional specifications for continuous ink jet printing.

However, use of precision machined metal has several adverse attributes. For example, only inert, low coefficient of thermal expansion (CTE), and structurally stiff metals machined to precise tolerances prove effective in meeting functional requirements for continuous ink-jet drop catchers. These requirements render high volume processes and inherently weak polymers useless for catchers. Secondly, conventional machining used to produce metal catcher geometry is constrained by tooling. This constraint means that the diameter of a cutter and/or its run-out that produces a part must be incorporated into the design. More times than not, this compromises basic ink-jet performance of a catcher. Prior art catcher face geometry molding has been limited to rigid thermo-set epoxies. These epoxies cannot be molded more than 1.5 inches in length without face flatness tolerance degradation that is at least twice the acceptable limit for new, higher speed and higher resolution inkjet printers. These epoxy parts are also not suitable structurally or thermally for printing array lengths greater than two inches.

Also, costs associated with conventional machining to obtain prior art are tremendous. The catcher component alone is as much as 17% of the cost of an entire continuous ink-jet print head. Finally, any damage or wear on a catcher face renders the part useless because of the difficulty associated with resurfacing compromised areas.

It is seen then that there is a need for a cost reduced catcher suitable for use with a continuous ink jet printer, that overcomes the adverse attributes associated with prior art catcher designs.

SUMMARY OF THE INVENTION

This need is met by the elastomeric polymer catcher device according to the present invention, wherein a metal insert is used to provide the catcher with the necessary structural stiffness.

In accordance with one aspect of the present invention, a catcher device is provided for a continuous ink jet printer of the kind for generating a row of parallel selectively charged drop streams catches charged ink drops. The catcher device combines the attributes of two different materials and two different processes to eliminate high cost, material limitations, and geometry constraints associated with prior art catcher constructions.

Other objects and advantages of the invention will be apparent from the following description, the accompanying drawings and the appended claims.

BRIEF DESCRIPTION OF THE DRAWINGS

FIG. 1 is a view of a catcher face molded to a metal core, in accordance with the present invention;

FIG. 2 is a close up view of the material combination resulting in the catcher construction of the present invention; and FIG. 3 is a table illustrating shrinkage rates for materials used in the catcher construction of the present invention.

DETAILED DESCRIPTION OF THE PREFERRED EMBODIMENTS

One significant purpose of the present invention is to provide a precision inkjet catcher device that utilizes low cost elastomeric polymers or rigid plastic-type polymers, and advantageous processes. The catcher manufacturing technique of the present invention significantly reduces catcher cost, allows complex catcher geometry to be made with precision, produces a thermally and structurally sound device, and introduces new materials that while not practical for use in the prior art, are beneficial to ink-jet performance.

The present invention combines the attributes of two different materials, metal and polymer, and two different processes, high speed/low tolerance metal fabricating and molding, to eliminate high cost, material limitations, and geometry constraints associated with prior art catcher construction. This approach utilizes a low precision metal core, and transfer or injection molding of a thin veneer of polymer, elastomeric or rigid, that constitutes a catcher face, onto the metal core. The materials and processes of the present invention have never been combined successfully to achieve the precision and size currently required in the art, for larger catcher faces that meet necessary flatness specifications.

Referring to the drawings, there is illustrated in FIGS. 1 and 2 a catcher assembly 10. A metal core 12, typically stainless steel in a preferred embodiment, serves as the thermal "driver" structural platform for the catcher assembly 10. The stainless steel core is close to the optimal thermal coefficient of expansion (TCE) needed to match the nickel and alumina used in existing printhead structures. Using normal polymer TCE'S would result in a TCE that would be magnitudes off the optimum. However, with the technique described herein, polymer(s) are forced to move with the metal core because of the structural superiority of the metal core. Hence, the polymer is rigidly coupled and stressed or "driven" by steel.

The metal core 12 can be produced by stamping, powder metal, low precision machining, or other suitable process. A catcher face 14, with dimensional geometry, is produced by a molding process. The catcher "face" 14 is molded onto the metal core 12 with a flatness less than 0.0002 inches, as is necessary for inkjet catcher performance. In a preferred embodiment, the steel core is loaded into a hot mold and then the polymer is injected (thermo plastic) or transferred (thermoset) onto the steel core. The polymer will adhere naturally under the pressure and heat applied during the molding. The precise geometries can be created by the molding operation. The critical dimensions are machined just once to create the mold and are replicated at very low cost through the molding process.

To achieve the tolerance for the catcher face 14, the catcher assembly 10 of the present invention meets several requirements. First, the metal component 12, for providing the catcher with the necessary structural stiffness, is exceptionally stiff in the direction that the polymeric catcher face 14 is transfer/injection molded. The part 10 does not deflect more than 10% of the desired final catcher "face" flatness tolerance during the molding process. In a preferred embodiment for manufacturing the catcher, loads calculations should use 5,000 P.S.I. as a minimum. It is preferred that the polymer thickness be kept thin, and most preferably under 1 mm. This minimizes polymer shrinkage during the cooling/curing process. The catcher face flatness requirement necessitates that the mold that produces the final tolerance is not more than 25% of the final part tolerance.

During any molding process, the polymeric material shrinks as it cools down from the molding temperature. Without proper design, such shrinkage would produce a catcher face that would be way out of tolerance for flatness down the length of an inkjet array and profile parallel to motion of the ink drops. To prevent this problem, the metal insert 12 is made to come reproducibly close to the face of the catcher. This ensures that the thickness of the plastic or elastomer on the catcher face is quite small. As the shrinkage of the polymeric material in any direction is proportional to the length of the material in that direction, keeping the thickness of the polymeric material small along the face of the catcher minimizes shrinkage and therefore distortion along the catcher face.

The shrinkage rates for two materials of interest for molding the catcher face in accordance with the present invention are shown in the table of FIG. 3. When considering the shrinkage rate for the EPDM elastomer in FIG. 3, it is seen that limiting the thickness of the polymer along the catcher face 14 to 0.1 inches thick will result in a shrinkage of the material along that face to 1.75 mil. While shrinkage per se is not necessarily a problem, shrinkage induced distortions can constitute a problem. As the polymeric material layer, which operates as the catcher face in accordance with the present invention, is much thinner and of lower stiffness than the metal insert 12, the difference in shrinkage rates between the polymer and the metal insert does not produce significant distortions. The technique of the present invention allows for the use of non-traditional catcher materials, specifically polymer and metal, to achieve behavioral differences in fluid friction performance over existing technology.

In practice, it is possible to produce catcher faces using the process of the present invention that maintain the flatness of the catcher face. Typically, the required flatness tolerance for the catcher face is 0.0002 inches per inch per inch down the length of the catcher face. High quality surface finishes can also be provided through this molding process. Required catcher geometries can be readily created in the polymeric catcher face, such as walls, rails, and channeling grooves.

The present invention provides several advantages over prior art constructions. For example, the mold is only built once, vastly reducing the cost of difficult, unique, and costly processes used in tool construction. The precision is built initially into the mold, and then transferred into every catcher, requiring only the single precision construction while achieving multiple precision components.

In accordance with the present invention, any inkjet-compatible polymer, including many elastomers, can be used to make a catcher. With the polymer coupled to the metal core, the catcher face will thermally and structurally follow the metal. Additionally, if a low surface energy (hydrophobic) polymer is advantageous for a particular application, it can now be molded in accordance with the present invention. Lower surface energy materials can help maintain the speed of the ink as it flows down the catcher face, keeping fluid film build-up to a minimum. With the help of this hydrophobic surface, drops will not wick out of their intended path. Prior art use of metal produced a high surface energy (hydrophilic) and caused ink to drift into undesirable areas.

It has been found that at the entrance to the catcher throat, sharp internal corners provide better fluid flow characteristics for the ink. Convention machining techniques of the prior art are not able to produce sharp internal corners in critical areas and therefore may compromise optimum catcher performance. With the molding technique of the present invention, sharp corners and even raised walls on a catcher face are possible. Also, exceptionally long catcher faces can be molded.

With the novel transfer/injection molding technique of the present invention, recovering a damaged catcher is as simple as cutting off the damaged face and remolding it onto the metal core. The core is the greatest cost component in this new system and it is therefore advantageous that the core can be salvaged. Existing art has required the part be scrapped if damaged.

While the transfer molding process of the present invention is of particular advantage for forming the high precision catcher face geometry as described above, the transfer molding process of the present invention can also be utilized for forming the fluid flow geometry on the bottom surface of the catcher face. As the fluid flow geometry can be quite complex, as described in U.S. Pat. No. 6,187,212 and EP 0 805 039, the transfer molding process of the present invention can provide further significant cost saving when used to form the fluid flow geometry as well.

The invention has been described in detail with particular reference to certain preferred embodiments thereof, but it will be understood that modifications and variations can be effected within the spirit and scope of the invention.

What is claimed is:

1. In a continuous ink jet printer for generating a row of parallel selectively charged drop streams from a fluid system, an improved drop catcher apparatus comprising:

a metal insert having structural stiffness in at least two directions; and a polymeric catcher face molded onto the metal insert so that the polymeric catcher face is adhered on the metal insert, in order that the metal insert provides structural stiffness in at least two directions to the catcher apparatus and provides structural stiffness in at least two directions to the polymeric catcher face.

2. An improved drop catcher apparatus as claimed in claim 1 wherein the polymeric catcher face is molded onto the metal insert by providing a transfer molding process so that the polymeric catcher face is adhered on the metal insert.

3. An improved drop catcher apparatus as claimed in claim 1 the polymeric catcher is molded onto the metal insert by providing an injection molding process so that the polymeric catcher face is adhered on the metal insert.

4. An improved drop catcher apparatus as claimed in claim 1 wherein the polymeric catcher face comprises an elastomeric polymer.

5. An improved drop catcher apparatus as claimed in claim 1 wherein the polymeric catcher face comprises a rigid polymer.

6. An improved drop catcher apparatus as claimed in claim 1 wherein the polymeric catcher face has a flatness of 0.0002 inches per inch lengthwise.

7. An improved drop catcher apparatus as claimed in claim 1 wherein the metal insert is a stamp piece.

8. An improved drop catcher apparatus as claimed in claim 1 wherein the metal insert is powder metal.

9. A method for fabricating a drop catcher device for use in a continuous ink jet printer for generating a row of parallel selectively charged drop streams from a fluid system, the method comprising the steps of:

providing a polymeric catcher face;

providing a metal insert having structural stiffness in at least two directions thereby providing structural stiffness to the catcher apparatus and providing structural stiffness to the polymeric catcher face; and molding the polymeric catcher face onto the metal insert.

10. A method as claimed in claim 9 wherein the step of molding comprises the step of transfer molding the polymeric catcher face onto the metal insert.

11. A method as claimed in claim 9 wherein the step of molding comprises the step of injection molding the polymeric catcher face onto the metal insert.

12. A method as claimed in claim 9 wherein the step of providing a polymeric catcher face further comprises the step of providing an elastomeric polymer.

13. A method as claimed in claim 9 wherein the step of providing a polymeric catcher face further comprises the step of providing a rigid polymer.

14. A method as claimed in claim 9 wherein the step of providing a metal insert further comprises the step of providing a low precision metal core.

15. A method as claimed in claim 9 wherein the step of providing a metal insert further comprises the step of producing the metal insert by stamping.

16. A method as claimed in claim 9 wherein the step of providing a metal insert further comprises the step of producing the metal insert by powder metal fabrication.

17. A method as claimed in claim 9 wherein the step of providing a metal insert further comprises the step of producing the metal insert by low precision machining.

18. A catcher apparatus comprising:

a metal insert having structural stiffness in at least two directions; and a polymeric catcher face molded onto the metal insert so that the polymeric catcher face is adhered on the metal insert, in order that the metal insert provides structural stiffness in at least two directions to the catcher apparatus and provides structural stiffness in at least two directions to the polymeric catcher face, and the polymeric catcher face comprises an elastomeric polymer.

* * * * *